United States Patent [19]

Rix

[11] 4,294,556

[45] Oct. 13, 1981

[54] GUIDE FOR RECORD CARRIER IN PRINTERS

[75] Inventor: Albert Rix, Wilhelmshaven, Fed. Rep. of Germany

[73] Assignee: Olympia Werke AG, Wilhelmshaven, Fed. Rep. of Germany

[21] Appl. No.: 56,001

[22] Filed: Jul. 9, 1979

[30] Foreign Application Priority Data

Jul. 7, 1978 [DE] Fed. Rep. of Germany ..... 2829827

[51] Int. Cl.[3] ..... B41J 3/04; B41J 13/18

[52] U.S. Cl. ..... 400/643; 101/416 A; 226/196; 400/126; 400/619; 400/647; 400/694

[58] Field of Search ..... 101/416 A; 226/196; 400/126, 619, 642, 643, 645.5, 119, 694, 578, 647, 647.1

[56] References Cited

U.S. PATENT DOCUMENTS

| | | | |
|---|---|---|---|
| 720,062 | 2/1903 | Peterson | 400/647 |
| 975,190 | 11/1910 | Woodward | 400/647 |
| 1,126,895 | 2/1915 | Smith | 400/647 |
| 1,861,009 | 5/1932 | Helmond | 400/647 |
| 2,297,490 | 9/1942 | Martin et al. | 400/647 |
| 2,506,934 | 5/1950 | Miller | 400/578 |
| 2,664,988 | 1/1954 | Metzner | 400/619 |
| 3,422,753 | 1/1969 | Strassner et al. | 400/119 |
| 4,009,877 | 3/1977 | Ward | 271/264 |
| 4,024,940 | 5/1977 | Hendrischk | 400/56 |
| 4,024,942 | 5/1977 | Kawaji | 400/58 |
| 4,165,029 | 8/1979 | Mitchell | 226/183 |
| 4,197,023 | 8/1977 | DeBoo | 400/578 |

FOREIGN PATENT DOCUMENTS

| | | | |
|---|---|---|---|
| 2459746 | 7/1975 | Fed. Rep. of Germany | 400/126 |
| 925345 | 5/1963 | United Kingdom | 400/642 |

*Primary Examiner*—William Pieprz

*Attorney, Agent, or Firm*—Spencer & Kaye

[57] ABSTRACT

A device for guiding a record medium sheet which is to be printed upon in a printing machine having a platen, the device being arranged to guide the sheet around the platen and including an apron member formed and positioned to hold the sheet in contact with the platen and to guide the sheet at a point closely below the line being printed, the member being constructed to conform to the curvature of the lower portion of the platen and presenting a press and guide edge at each end of the member in the direction of the circumference of the platen, and a spring biassing component disposed for pressing the member resiliently against the platen to cause the edges to bear against the platen, the member being of a material selected so that the coefficient of friction between the record medium sheet and the press and guide edges is less than the coefficient of friction between the platen and the record medium sheet.

14 Claims, 3 Drawing Figures

GUIDE FOR RECORD CARRIER IN PRINTERS

BACKGROUND OF THE INVENTION

The present invention relates to a guide for record carriers, in the form of sheets, e.g. of paper, in printers of the type in which the record carrier is introduced into the printer, via an apron and under the influence of advancing means, so as to pass around a platen, and the carrier is held in contact with the platen and is guided at a location closely below the line being printed.

Typewriters and similar machines employing a platen as the printing abutment are generally provided with a guide device in the form of a trough-shaped metal guide member in the lower carrier, or paper guide region. This metal member extends over the entire width of the platen and is provided with longitudinally oriented recesses on both sides through which protrude further guide devices in the form of resiliently mounted pressure rollers. The rollers and the guide metal member press the paper against the platen, thus assuring slip-free transport and reliable movement of the paper during rotation of the platen. In order to insert and align the paper, the pressure rollers can be lifted away from the platen.

In order to avoid jamming of the paper, the above-mentioned paper guide devices require high accuracy in the dimensions of the member. Mainly, the guide rollers disposed in this member must be precisely flush. Such high manufacturing accuracy of course entails high costs which are no longer acceptable for economical mass production.

SUMMARY OF THE INVENTION

It is an object of the present invention to provide an easily adjustable guide for record carriers in printers, which guide is simple in structure and inexpensive to manufacture.

The objects of the invention are achieved by the provision of a device for guiding a record medium sheet which is to be printed upon in a printing machine having a platen, the device being arranged to guide the sheet around the platen and including: an apron member formed and positioned to hold the sheet in contact with the platen and to guide the sheet at a point closely below the line being printed, the member being constructed to conform to the curvature of the lower portion of the platen and presenting a press and guide edge at each end of the member in the direction of the circumference of the platen; and spring biasing means disposed for pressing the member resiliently against the platen to cause the edges to bear against the platen, the member being of a material selected so that the coefficient of friction between the record medium sheet and the press and guide edges is less than the coefficient of friction between the platen and the record medium sheet.

The device according to the present invention is simple and operates reliably for guiding record carriers, e.g. paper sheets, in printers. It offers the advantage of permitting elimination of the paper guide rollers and the paper holding rollers of the prior art devices.

Certain preferred embodiments of the present invention are well suited for use in ink ejector printers. This makes it possible to arrange the individual printing elements of a mosaic printing head so that they are all at the same distance from the record carrier, thus assuring a more uniform imprint quality.

Particular preferred embodiments of the invention are quite effective in avoiding jamming of the paper in the area of the guide member.

DESCRIPTION OF THE PREFERRED EMBODIMENTS

Figure 1:
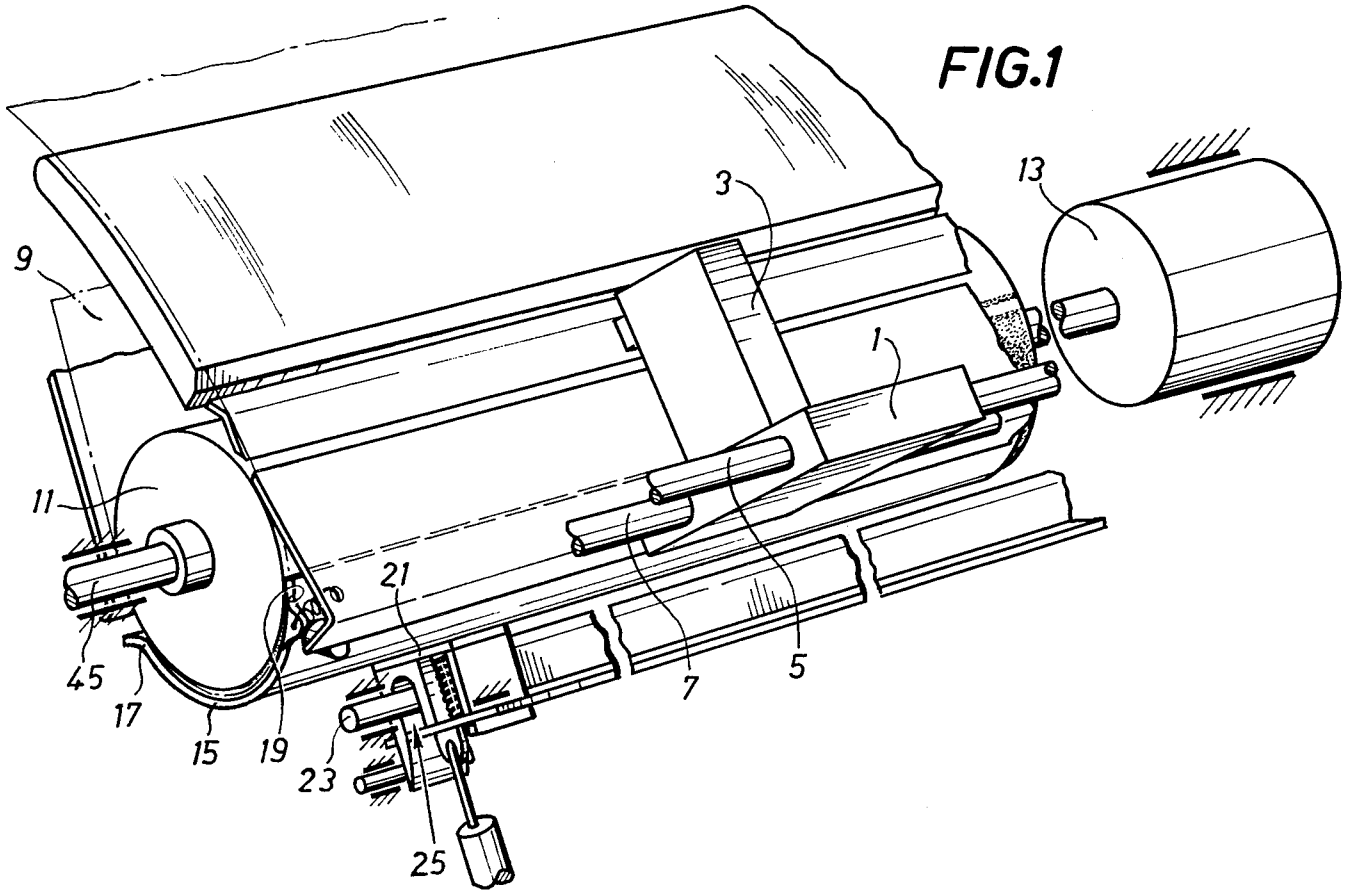
FIG. 1 is a perspective view of a preferred embodiment of the present invention installed in an ink ejection printer.

FIG. 1 shows a portion of an ink ejection printer which includes a carriage 1 with a mosaic printer disposed thereon, the printer including, for example, an ink ejection printing head 3 which is guided to be movable along shafts 5 and 7 parallel to the axis of a platen 11 constituting a transporting element for a record carrier, e.g. a paper sheet, 9. The carriage 1 is transported along the platen 11, and thus across the record carrier 9, by suitable known means and the platen and record carrier are advanced in stages after each line has been printed by means of a transporting device, e.g. a stepping motor 13.

It is of course also possible, within the scope of the present invention, to advance the platen 11 manually via a platen rotating knob (not shown).

Guidence for the record carrier 9 is provided, in the lower region of coverage, by a guide apron 15 of a shape adapted to the curvature of the platen 11. This apron is pressed in a self-centering manner by spring pressure against the platen 11. The apron 15 here contacts the platen 11 via its press and guide edges 17 and 19 in the entrance and exit regions respectively of the platen 11.

Figure 2:
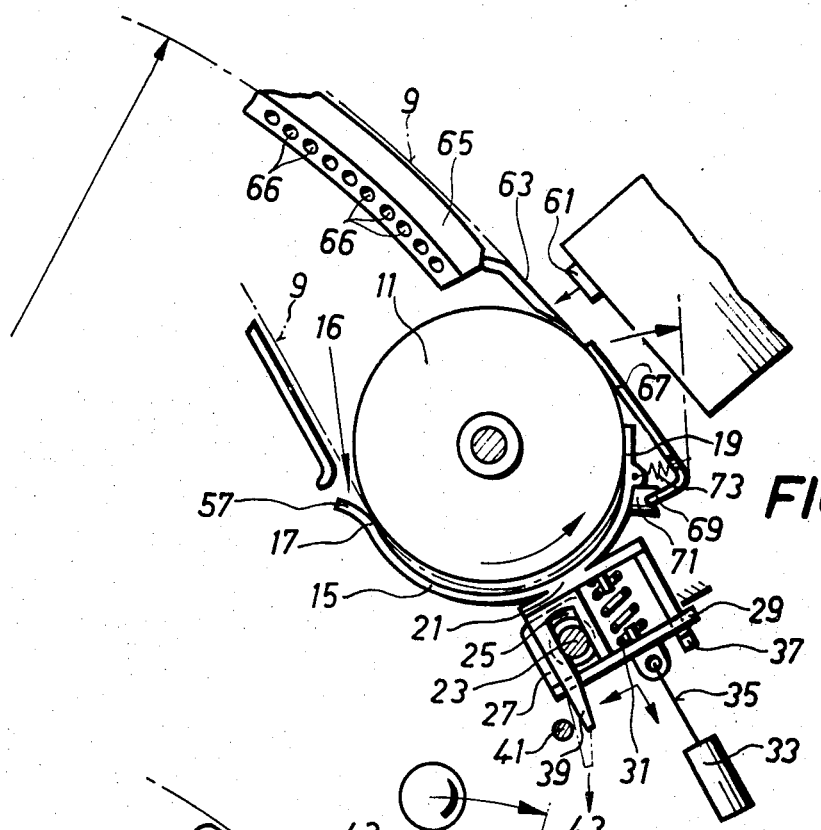
FIG. 2 is an axial cross-sectional view of the embodiment of FIG. 1.
Figure 3:
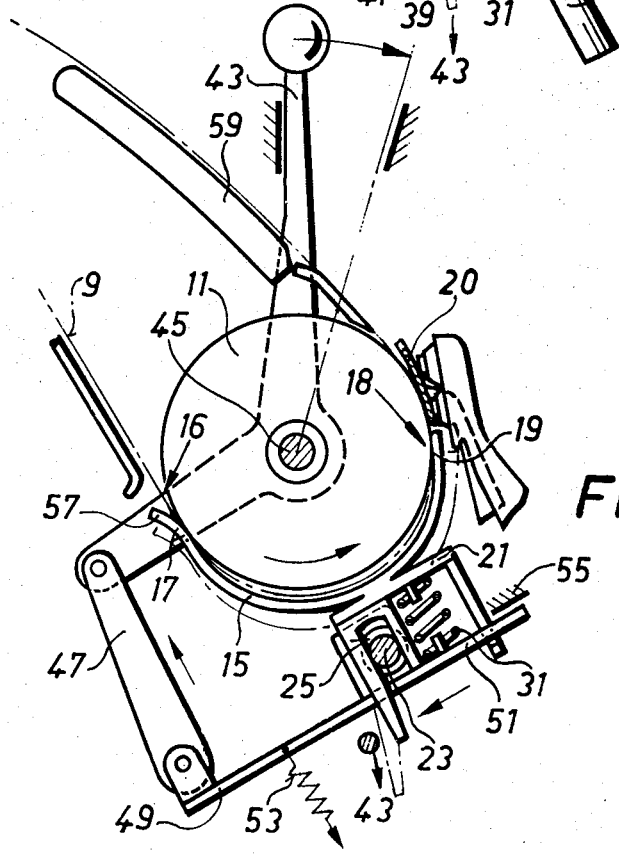
FIG. 3 is an axial cross-sectional view of a second preferred embodiment of the present invention installed in a typewriter-type, type bar printer.

In order to achieve fault free transport of the record carrier 9, it is necessary for the press and guide edges 17 and 19 to each contact the record carrier 9 along as straight a line as possible. To realize this without excess manufacturing costs, the apron 15 is subdivided along the platen axis into a plurality of individual aprons. Each individual apron 15 has fixed thereto at least one saddle-shaped bearing member 21, only one of which is shown in each of the drawing figures, mounted to be axially displaceable and pivotal on the axis of a shaft 23 via a guide slot 25, and being disposed along the platen 11 as part of the machine housing. Each saddle member 21 has an associated pivot lever 27, as shown in FIGS. 2 and 3, which is arranged to be pivotal about axis 23 and is settable and adjustable by means of a control device provided in the machine housing. One or more compression springs 31 are interposed between each saddle member 21 and an abutment arm 29 of the associated pivot lever 27 so that the springs 31 press each apron 15 against the platen 11.

In order to align the record carrier 9, the aprons 15 are arranged so that they can be lifted away from the platen 11. For this purpose, the pivot levers 27 are pivoted clockwise by by a control device 33 via a connecting rod 35, thus causing abutment arms 29 to act on abutment tongues 37 forming a unit with the saddle members 21. The saddle members 21 are first carried along with the clockwise rotation of levers 27 until an abutment arm 39 of each member 21 abuts against a shaft 41 which is fixed to the machine housing. After abutting there, the saddle members 21 and thus the aprons 15 are carried along in the direction of the arrow 43. As shown in FIG. 3, the aprons 15 are carried along from the position shown in dash-dot lines. Now it is possible to properly align the record carrier.

The control device 33 for lifting away the aprons may be, for example, an electromagnet or, as shown in FIG. 3, a release lever 43 which can be pivoted manually between two end positions. This release lever 43 is arranged to be pivotal about the axis 45 of the platen 11 and is articulated by means of a connecting rod 47 to the lever arm 49 of a rocker 51 which is pivotal about the axis of shaft 23. This rocker 51 is arranged to be pivotal against the force of a spring 53 away from an abutment 55 at the machine housing so as to lift all saddle members, and thus all aprons 15, away from the platen 11 when lever 43 is moved from the position shown in the direction of the associated arrow. If the release lever 43 is reset again to the position shown in solid lines in FIG. 3, then the rocker 51 again rests against the abutment 55. In a type bar printer, the record carrier 9 is guided in a known manner in the area of the imprint region by a conventional line adjuster 20.

The insertion of the record carrier 9 into the guide is facilitated by providing aprons 15 with guide projections 57 which are curved away from the platen 11 and from edge 17. Reliable transporting of the record carrier 9 by the platen 11 driven by the stepping motor 13 is assured by making the platen 11 and apron 15 of materials such that the coefficient of friction between the record carrier 9 and the press and guide edges 17 and 19 is less than the coefficient of friction between the platen and the record carrier 9. This is accomplished, for example, in that the aprons 15, which are made of steel sheets, are provided with a coating having a low coefficient of friction, e.g. a Teflon coating.

In type bar printers of the type shown in FIG. 3, the platen 11 serves simultaneously as a transporting and printing roll. In the exit region 18 the press and guide edges 19 then contact the platen over the entire length of the platen, immediately below the printed line. This assures that the record carrier 9 is held tightly against the platen 11 in the printing area so that the imprint will always be uniform. After leaving the printing zone, the record carrier 9 is directed into free space over a guide face 59.

With ink ejection printers such as depicted in FIG. 2, it is desirable that the distance between the ink ejection head 61 and a recording surface 63 be as uniform as possible. For this purpose the record carrier is conducted, immediately after leaving the platen 11, over an obliquely oriented flat support surface 63 which is followed by a contact face 65 in the form of a drying device for the record carrier 9 leaving the printing region, the record carrier following the curvature of the contact face 65 if possible without forming bulges, or cavities. The record carrier 9 always should be in full contact with the contact face 65, which is in the form of a heating plate. This heating plate includes, by way of example, electrical heating elements 66 that heat soften the ink particles to bond them fast to the record carrier 9. The drying of the ink particles on the record carrier 9 is not successful if there are bubbles or cavities between the record carrier 9 and the contact face 65.

In order for the record carrier 9 to always be in full contact with the recording surface 63, the record carrier is pressed against the platen 11, immediately before leaving it, along a line of contact under the action of a holding rail 67 extending in the axial direction of the platen 11. Rail 67 acts to supplement the pressure from the two press and guide edges 17 and 19 of the aprons 15. The holding rail 67 is pivotally mounted via edges 69 in edge bearings 71 disposed at apron 15. The holding rail 67 is pressed against the platen 11 by tension springs 73 connected between it and the apron 15.

The linear contact of the holding rail 67 is followed directly by the recording surface 63 which lies on a tangent to the circumferential face of the platen 11 that is inclined by about 30° to the vertical. Due to this inclined orientation of the recording surface 63, and the curvature of the contact face 65, the record carrier 9 is brought into the open without the formation of cavities so that in the area of the recording surface the record carrier 9 is always in firm contact so as to produce an always uniform imprint.

The guide according to the invention is distinguished by its simple and surprisingly reliable design so that it can even be used for correspondence typewriters employing ink ejection printers.

It is to be understood that the above description of the present invention is susceptible to various modifications, changes and adaptations, and the same are intended to be comprehended within the meaning and range of equivalents of the appended claims.

What is claimed is:

1. A device for guiding a record medium sheet which is to be printed upon in a printing machine having a platen, said device being arranged to guide the sheet around the platen and comprising: an apron member formed and positioned to hold the sheet in contact with said platen and to guide the sheet at a point closely below the line being printed, said member being constructed to conform to the curvature of the lower portion of said platen and presenting a press and guide edge at each end of said member in the direction of the circumference of said platen; and spring biassing means disposed for pressing said member resiliently against said platen to cause said edges to bear against said platen; wherein said member is of a material selected so that the coefficient of friction between the record medium sheet and said press and guide edges is less than the coefficient of friction between said platen and the record medium sheet, said apron member is provided with at least one bearing portion presenting a guide slot, said portion being mounted to be slidable and pivotal relative to a pivot axis fixed relative to the machine and extending parallel to the axis of said platen, said spring biassing means act on said member via said bearing means, and said spring biassing means are constructed and mounted for pressing said apron member against said platen in a manner to establish a self-centering action between said press and guide edges and said platen.

2. Device as defined in claim 1 wherein said platen simultaneously serves to advance the sheet and to support the sheet during printing and said press and guide edge adjacent the region where a line is printed contacts said platen over the entire length of said platen closely below the line being printed.

3. Device as defined in claim 1 wherein the printing machine is of a nonmechanical type, and further comprising means defining an obliquely oriented, flat printing surface disposed to receive the sheet immediately beyond the region where it contacts said platen and to support the sheet in the region where it is being printed, and means defining a contact surface located adjacent said printing surface and having the form of a drying device for the record medium sheet leaving the printing region, said contact surface being arranged to permit the sheet to follow its curvature without forming cavities.

4. Device as defined in claim 3 wherein the printing machine employs an ink ejection printer.

5. Device as defined in claim 3 further comprising a holding bar formed to press the sheet against said platen along a linear path just ahead of the point where the sheet departs from said platen, said bar extending in the longitudinal direction of said platen and acting in cooperation with said press and guide edges.

6. Device as defined in claim 3 wherein said printing surface is tangent to the circumferential surface of said platen and is inclined by about 30° with respect to the vertical.

7. Device as defined in claim 1, 2 or 3, wherein said apron member is made of steel sheet and is provided with a coating having a low coefficient of friction.

8. Device as defined in claim 7 wherein the coating is of Teflon.

9. Device as defined in claim 1, 2, 3 or 4 wherein said apron member bearing portion is saddle-shaped.

10. Device as defined in claim 9 further comprising a control lever mounted to pivot about said pivot axis and having an abutment arm and a control member connected to control the pivoting movement of said lever, and wherein said spring biasing means comprise at least one compression spring held in compression between said bearing portion and said abutment arm.

11. Device as defined in claim 10 wherein said control member comprises: a release lever mounted to be manually pivoted between two end positions about an axis fixed relative to the machine; and a connecting rod pivotally connected between said release lever and said control lever.

12. Device as defined in claim 1 wherein said apron member is subdivided along the axis of said platen into a plurality of partial members.

13. Device as defined in claim 1 wherein said apron member and said spring biassing means are configured for causing a record medium sheet to be held against said platen in the region of said apron member exclusively by the action of said press and guide edges.

14. Device as defined in claim 13 further comprising means connected to said apron member and operable for moving said apron between the position in which it is pressed resiliently against said platen and a position in which said apron member is spaced from said platen.

* * * * *